United States Patent [19]

Blake

[11] 4,016,973

[45] Apr. 12, 1977

[54] PLASTIC HOLDER FOR SAFETY MATCHES

[76] Inventor: Richard E. Blake, 3110 Frederick Ave., Colonial Heights, Va. 23834

[22] Filed: Oct. 6, 1975

[21] Appl. No.: 619,839

[52] U.S. Cl. ..... 206/107; 206/1.5; 206/118

[51] Int. Cl.[2] ..... A24F 27/04

[58] Field of Search ..... 206/1.5, 96–120, 206/131, 132; 150/7; 229/36, 39 R, 45 R, 82, 84

[56] References Cited

UNITED STATES PATENTS

| | | | |
|---|---|---|---|
| 331,800 | 12/1885 | Lockwood | 229/39 R |
| 1,588,448 | 6/1926 | Colgate | 206/118 |
| 1,657,789 | 1/1928 | Colgate | 206/118 |
| 2,167,917 | 8/1939 | Vogt | 229/39 R |
| 2,522,049 | 9/1950 | Lang | 229/36 |
| 3,004,699 | 10/1961 | Stires | 229/84 |
| 3,081,017 | 3/1963 | Gerbino | 229/39 R |
| 3,261,537 | 7/1966 | Kistner | 229/45 R X |
| 3,306,436 | 2/1967 | Diehl | 206/118 |

*Primary Examiner*—William Price
*Assistant Examiner*—Stephen Marcus
*Attorney, Agent, or Firm*—Low & Matthews

[57] ABSTRACT

A plastic holder for safety matches or bookmatches which completely enfolds a typical pack of bookmatches and locks in such a manner that it is difficult for children to open and gain access to the matches. The plastic holder is formed with a pouch to receive the pack of matches which exposes the striker area on the pack when the holder is open. The holder requires a squeezing-twisting motion in order to lock the holder around the pack of matches and a reverse motion of twisting and squeezing is required in order to open the holder.

8 Claims, 4 Drawing Figures

PLASTIC HOLDER FOR SAFETY MATCHES

The invention relates to a plastic holder for bookmatches, and, more particularly, to such a holder which is provided with a lock which is sufficiently secure so as to make it difficult to be opened by small children.

Because of the innate curiosity of children which leads them to play with matchbook covers and because of their fascination with fire, a need exists to provide a more secure holder for packs of safety matches which may be left inadvertently around the house and accessible to small children.

In accordance with the present invention, a plastic holder is provided which is virtually inaccessible to small children because the holder is effectively locked so that it becomes virtually impossible for a small child to open without deliberately instructing the child how the holder can be opened. Therefore, packs of safety matches or bookmatches may be left around the house securely locked within the holder of the present invention without fear that a child may open the same and strike a match on the strikable portion and start a fire.

The plastic holder of the present invention is preferably made from a durable, flexible and non-flammable plastic material, such as polypropylene, which is virtually impossible for a child to open without being given instructions on how to accomplish same.

In particular, the plastic holder of the present invention provides a pouch or recess into which a conventional pack of bookmatches or safety matches is received. The plastic holder is provided with top, front and overlap panels which are foldable along fold lines between adjacent panels to a closed position which envelops the pack of bookmatches. The overlap panel is provided with at least two locking tab means at its free end which are adapted to be inserted by a squeezing and twisting action into respective locking tab-receiving means in the rear panel. The latter are angularly positioned on the rear panel so as to necessitate the squeezing and twisting of the overlap panel to effect insertion into the locking tab-receiving means. In order to open the holder, the reverse motion must be imparted to the overlapping panel, namely, a twisting and squeezing motion.

The plastic holder has a pouch to which the aforementioned panels are attached and within which the bookmatches are received. The pouch itself includes a bottom section which supports the bottom of the bookmatches and which extends a short distance over the bottom marginal edge of the bookmatches but which leaves the striker plate uncovered when the panels of the holder are unfolded to an open position.

The locking tab-receiving means on the rear panel of the plastic holder are provided with a first cut-out portion substantially rectangular in shape and a narrow slit portion extending from one of the corners of the rectangularly shaped first cut-out portions but at an oblique angle thereto. With respect to the plastic holder, the narrow slit portions are parallel to each other and to the longitudinal direction or axis of the rear panel. The rectangularly-shaped cut-out portions are aligned parallel to each other but at an acute angle to the longitudinal direction of the rear panel and extend in opposite directions from their respective narrow slit portions.

The inherent advantages and improvements of the present invention will become more readily apparent upon considering the following detailed description of the invention and by reference to the drawings, in which.

Figure 1:
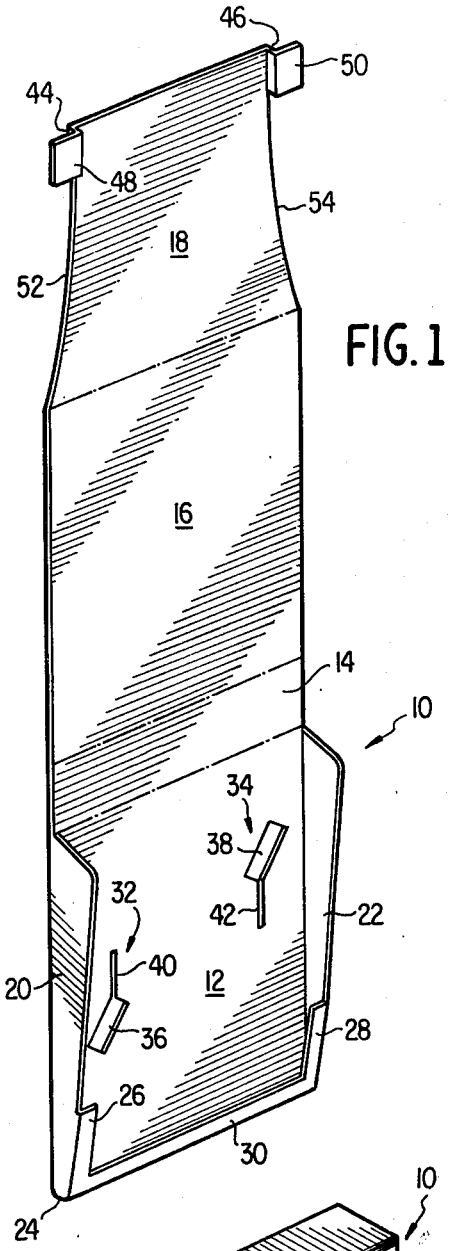
FIG. 1 is a perspective view of the plastic holder for safety matches made in accordance with the present invention.

Referring now to FIG. 1 of the drawings, there is illustrated a plastic holder, indicated generally at 10, made from a plastic such as polypropylene. Holder 10 is shown to have a rear panel 12, a top panel 14 hingedly secured thereto, a front panel 16 and an overlapping panel 18. Panels 16 and 18 are also foldable along the dashed lines between adjacent panels.

The holder 10 is provided with a pouch construction by providing rear panel 12 with ribs at 20 and 22, a rounded bottom at 24, foreshortened flaps 26 and 28 and a shallow front strip 30 adjacent bottom 24. In use, the shallow front strip 30 extends a short distance over the bottom marginal edge of a pack of bookmatches, not shown, but which leaves the striker plate on the bookmatches uncovered when the plastic holder is opened as is illustrated in FIG. 1.

Rear panel is provided with a pair of cut-outs indicated generally at 32 and 34 which comprise locking tab-receiving means. Each of the latter are composed of rectangularly-shaped tab-receiving openings 36 and 38 and narrow slits 40, 42. As can be seen most clearly in FIGS. 1 and 3, the narrow slits 40 and 42 are parallel to each other and also parallel to the longitudinal direction or axis of the rear panel 12. On the other hand, the rectangularly-shaped cut-out portions 36 and 38 extend in opposite directions therefrom and at an acute angle to the longitudinal direction or axis of the rear panel 12 toward the marginal edges thereof. As can best be seen in FIG. 3, this construction necessitates that a twisting action be imparted to overlapping panel 18 so that flaps 48 and 50 can be initially inserted into openings 36 and 38 and then into narrow slits 40 and 42.

Figure 2:
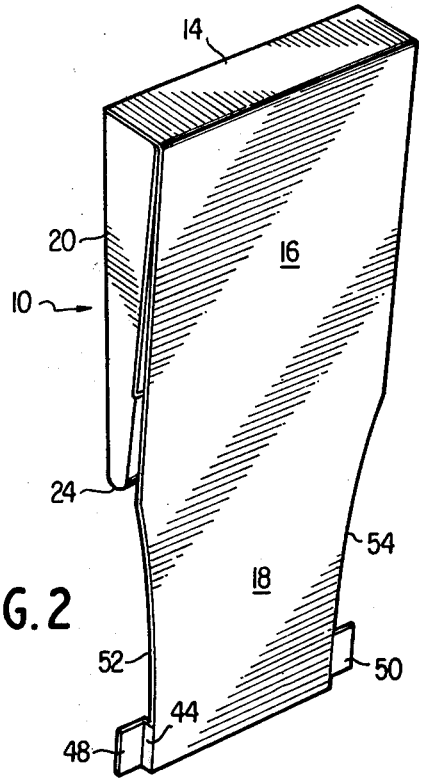
FIG. 2 is a perspective view of the holder of FIG. 1 shown in a partially folded position.
Figure 3:
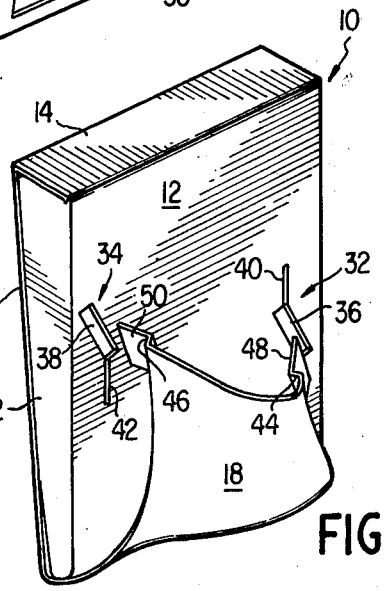
FIG. 3 is a perspective view of the holder of FIG. 1 shown immediately prior to being closed; and, FIG. 4 is a perspective view of the holder of FIG. 1 shown in its completely folded or closed position and turned over from the position shown in FIG. 2.

Locking tabs are formed at the free end of the overlap panel 18. Reference to FIG. 1 illustrates that locking tabs extend laterally from the free end of overlapping panel 18 and consist of inwardly bent flaps 44 and 46 to which flap extensions or locking flaps 48 and 50 are attached. The overlapping panel 18 is provided with inwardly flared edges 52 and 54 so proportioned and shaped that the plastic holder after it has been folded through the series of steps illustrated in FIGS. 2 and 3 must be squeezed and twisted in order to be inserted into the locking tab-receiving means 32 and 34. In order to remove the locking tab means from the locking tab-receiving means the overlapping panel 18 must be first twisted and then squeezed. That is, the cutouts or locking tab-receiving means 32 and 34 are so spaced from each other relative to the spacing between the locking flaps 48 and 50 that the overlapping panel 18 must be squeezed and twisted, as indicated in FIG. 3, in order to insert the locking flaps 48 and 50 into the cutouts 32 and 34.

This construction makes it virtually impossible for children to open and gain access to the safety matches within the plastic holder. By making the plastic holder 10 from polypropylene, a durable, flexible and non-flammable holder is provided.

Figure 4:
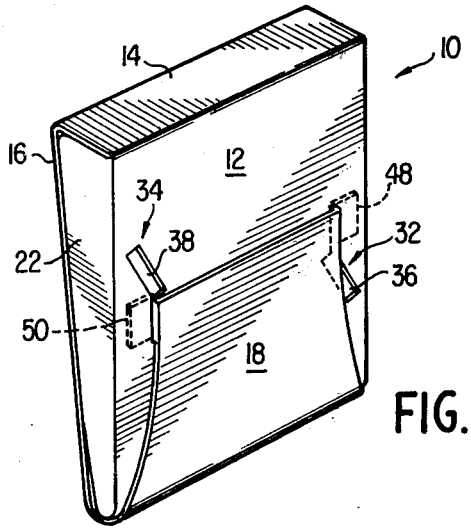

The pouch construction most clearly shown in FIG. 1 has the side ribs 20 and 22 which also prevent the child's finger from being inserted through the side of the holder to gain access to the safety matches. In the preferred form, as shown in FIGS. 2–4, the side ribs 20 and 22 provide substantially complete side closures for the holder and are in abutting relationship with front panel 16 in the fully closed position.

While a presently preferred embodiment of the invention has been illustrated and described, it will be recognized that the invention may be otherwise variously embodied and practiced within the scope of the claims which follow.

What is claimed is:

1. A plastic holder for receiving safety matches which comprises:

a. a pouch to receive a pack of bookmatches, one portion of which constitutes a rear panel of said plastic holder, b. top, front and overlap panels of said plastic holder being foldable along fold lines between adjacent panels to a closed position in which said panels envelop said pack of bookmatches, 1. said overlap panel overlapping at least a portion of said rear panel when said plastic holder is folded into its closed position, 2. said overlap panel being provided with at least two spaced apart foldable locking tab means at one end thereof, c. and a spaced pair of locking tab-receiving means provided on said rear panel, 1. said locking tab-receiving means including angularly positioned cut-out portions so spaced with respect to the spacing of said foldable locking tab means on said overlap panel that in order to insert said foldable locking tab means on said overlap panel into said locking tab-receiving means, said overlap panel must be squeezed and twisted; and in order to remove said locking tab means from said locking tab-receiving means, said overlap panel must be twisted and squeezed, 2. each of said locking tab-receiving means in said rear panel constitutes first and second cut-out portions with said first cut-out portion thereof being wider than said second cut-out portion so as to readily receive and release a locking tab and with said second cut-out portion being narrower so as to lock said locking tabs in position.

2. A plastic holder for receiving safety matches as claimed in claim 1 wherein said pouch includes rib means which prevents said pack of bookmatches from falling out of said plastic holder in a lateral direction.

3. A plastic holder for receiving safety matches as claimed in claim 1 wherein said pouch further includes a bottom section which supports the bottom of said bookmatches and which extends a short distance over the bottom marginal edge of said bookmatches but which leaves the striker plate uncovered when said panels are unfolded to an open position for said plastic holder.

4. A plastic holder for receiving safety matches as claimed in claim 1 wherein said plastic material is polypropylene.

5. A plastic holder for receiving safety matches as defined in claim 1 wherein each of said locking tab-receiving means in said rear panel constitutes a first cut-out portion substantially rectangular in shape and a narrow slit portion extending from one of the corners of said rectangularly shaped first cut-out portion and at an oblique angle thereto.

6. A plastic holder for receiving safety matches as defined in claim 5 wherein said rectangularly-shaped first cut-out portions of each of said locking tab-receiving means are aligned parallel to each other and extend in opposite directions from their respective narrow slit portions.

7. A plastic holder for receiving safety matches as claimed in claim 6 wherein said narrow slit portions are parallel to each other and also parallel to the longitudinal direction of said rear panel.

8. A plastic holder for receiving safety matches as claimed in claim 7 wherein said plastic material is polypropylene.

* * * * *